US009249947B2

(12) United States Patent
Goldstein et al.

(10) Patent No.: US 9,249,947 B2
(45) Date of Patent: Feb. 2, 2016

(54) LED-BASED LUMINAIRE HAVING A MIXING OPTIC

(75) Inventors: Peter Isaac Goldstein, Medford, MA (US); Eric Anthony Roth, Tyngsboro, MA (US)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 122 days.

(21) Appl. No.: 14/344,070

(22) PCT Filed: Aug. 27, 2012

(86) PCT No.: PCT/IB2012/054371

§ 371 (c)(1), (2), (4) Date: Mar. 11, 2014

(87) PCT Pub. No.: WO2013/041993

PCT Pub. Date: Mar. 28, 2013

(65) Prior Publication Data

US 2014/0340910 A1 Nov. 20, 2014

Related U.S. Application Data

(60) Provisional application No. 61/538,188, filed on Sep. 23, 2011.

(51) Int. Cl.

| | |
|---|---|
| ***F21V 7/00*** | (2006.01) |
| ***F21K 99/00*** | (2010.01) |
| ***F21S 4/00*** | (2006.01) |
| ***F21V 7/05*** | (2006.01) |
| *F21V 3/00* | (2015.01) |
| *F21V 13/02* | (2006.01) |
| *F21Y 103/00* | (2006.01) |
| *F21Y 113/00* | (2006.01) |

(52) U.S. Cl.

CPC ..... *F21V 7/0033* (2013.01); *F21K 9/00* (2013.01); *F21K 9/50* (2013.01); *F21S 4/003* (2013.01); *F21V 7/05* (2013.01); *F21V 3/00* (2013.01); *F21V 7/005* (2013.01); *F21V 7/0016* (2013.01); *F21V 13/02* (2013.01); *F21Y 2103/003* (2013.01); *F21Y 2113/005* (2013.01)

(58) Field of Classification Search

CPC ..... F21K 9/00; F21K 9/50; F21S 4/003; F21V 3/00; F21V 7/05; F21V 7/005; F21V 7/0033; F21V 7/0016; F21V 13/02; F21Y 2103/003; F21Y 2113/005

See application file for complete search history.

(56) References Cited

U.S. PATENT DOCUMENTS

| | | | | |
|---|---|---|---|---|
| 6,016,038 | A | 1/2000 | Mueller et al. | |
| 6,211,626 | B1 | 4/2001 | Lys et al. | |
| 2006/0245208 | A1 | 11/2006 | Sakamoto et al. | |
| 2007/0045524 | A1 | 3/2007 | Rains, Jr. et al. | |
| 2007/0274096 | A1 | 11/2007 | Chew et al. | |
| 2009/0168395 | A1 | 7/2009 | Mrakovich et al. | |
| 2013/0200407 | A1* | 8/2013 | Roth | F21V 7/0016 257/91 |

FOREIGN PATENT DOCUMENTS

| | | | |
|---|---|---|---|
| DE | 10164033 | A1 | 7/2003 |
| KR | 2008080975 | A | 9/2008 |
| WO | 0167427 | A2 | 9/2001 |

* cited by examiner

*Primary Examiner* — Stephen F Husar

(74) *Attorney, Agent, or Firm* — Meenakshy Chakravorty

(57) ABSTRACT

Disclosed is an LED-based luminaire (10, 110, 210, 310, 410, 510, 610, 710) including an optic surrounding a plurality of LEDs (140, 240, 340, 440, 540, 640*a/b*, 740). The optic may include a plurality of interior reflective surfaces for mixing light output of the LEDs and also include a transmissive diffuser (30, 130, 230, 330, 430, 530, 630*a/b*, 730*a/b*) through which interiorly reflected light output of the LEDs exits the LED-based luminaire.

22 Claims, 6 Drawing Sheets

LED-BASED LUMINAIRE HAVING A MIXING OPTIC

TECHNICAL FIELD

The present invention is directed generally to an LED-based luminaire. More particularly, various inventive methods and apparatus disclosed herein relate to an LED-based luminaire having a mixing optic surrounding a plurality of LEDs.

BACKGROUND

Digital lighting technologies, i.e. illumination based on semiconductor light sources, such as light-emitting diodes (LEDs), offer a viable alternative to traditional fluorescent, HID, and incandescent lamps. Functional advantages and benefits of LEDs include high energy conversion and optical efficiency, durability, lower operating costs, and many others. Recent advances in LED technology have provided efficient and robust full-spectrum lighting sources that enable a variety of lighting effects in many applications. Some of the fixtures embodying these sources feature a lighting module, including one or more LEDs capable of producing different colors, e.g. red, green, and blue, as well as a processor for independently controlling the output of the LEDs in order to generate a variety of colors and color-changing lighting effects, for example, as discussed in detail in U.S. Pat. Nos. 6,016,038 and 6,211,626, incorporated herein by reference.

In many lighting fixtures (or "luminaires") that embody one or more LEDs capable of producing different colors, it may be desirable to appropriately mix the light output of such LEDs prior to the light output exiting the LED-based lighting fixture. Appropriate mixing of the LEDs may reduce the presence of any undesired chromatic nonuniformity in the light output of the lighting fixture and provide more desirable light output characteristics. In implementing mixing solutions, many lighting fixtures employ multiple large mixing chambers and/or only provide illumination from a single planar light exit opening. Such configurations may result in an undesirably large mixing solution and/or a mixing solution of limited utility.

Thus, there is a need in the art to provide an LED-based luminaire that may provide satisfactory mixing of light output from a plurality of LEDs thereof and that may optionally overcome one or more drawbacks with existing mixing solutions.

SUMMARY

The present disclosure is directed to inventive methods and apparatus for an LED-based luminaire including a mixing optic surrounding a plurality of LEDs. The mixing optic includes a plurality of interior reflective surfaces for mixing light output of the LEDs. The mixing optic also includes a transmissive diffuser through which interiorly reflected light output of the LEDs exits the LED-based luminaire. In some implementations, a plurality of the LED-based luminaires may be installed adjacent one another on one or more installation surfaces, with each LED-based luminaire forming a single pixel of a multi-pixel display.

Generally, in one aspect, an LED-based luminaire includes a lower reflective surface and a plurality of LEDs atop the lower reflective surface. The LEDs include a first LED of a first color and a second LED of a second color distinct from the first color. A blocking reflective surface is provided over the LEDs pasta zenith of the LEDs and extending toward a rear reflective surface. A transmissive diffuser extends over the blocking reflective surface. The blocking reflective surface is interposed between the lower reflective surface and the transmissive diffuser. At least some of a light output from the LEDs is reflected by the blocking reflective surface, the lower reflective surface, then the rear reflective surface prior to passing through the transmissive diffuser.

In some embodiments the transmissive diffuser is arcuate.

In some embodiments the transmissive diffuser is out of a line of sight to the LEDs.

In some embodiments the blocking reflective surface is linear.

In some embodiments the rear reflective surface and the lower reflective surface are substantially perpendicular to one another.

Generally, in another aspect, an LED-based luminaire includes a lower reflective surface and a plurality of LEDs adjacent the lower reflective surface and primarily directing a light output away from the lower reflective surface. The LEDs include a first LED of a first color and a second LED of a second color distinct from the first color. A blocking reflective surface is also included spaced from the LEDs and intersecting a majority of the light output from the LEDs. A rear reflective surface is also included extending upward from adjacent the lower reflective surface and spaced from the blocking reflective surface. A transmissive diffuser is also included extending over the blocking reflective surface. The transmissive diffuser has a line of sight to at least portions of the rear reflective surface and does not have a line of sight to the LEDs. At least some of the light output from the LEDs is reflected by the blocking reflective surface, the lower reflective surface, then the rear reflective surface prior to passing through the transmissive diffuser. At least some of the light output is reflected by the rear reflective surface, without first reflecting off of the blocking reflective surface and the lower reflective surface, prior to passing through the transmissive diffuser.

In some embodiments, the lower reflective surface is planar. In some versions of those embodiments the rear reflective surface is planar and the rear reflective surface and the lower reflective surface are substantially perpendicular to one another.

In some embodiments, the blocking reflective surface is planar. In some versions of those embodiments the blocking reflective surface and the lower reflective surface are at a fifteen to forty degree angle relative to one another.

In some embodiments, at least one of the lower reflective surface, the blocking reflective surface, and the rear reflective surface is diffusely reflective.

In some embodiments, at least one of the lower reflective surface, the blocking reflective surface, and the rear reflective surface is specularly reflective. In some versions of those embodiments the lower reflective surface and the blocking reflective surface are specularly reflective and the rear reflective surface is diffusely reflective.

In some embodiments, the transmissive diffuser is arcuate.

In some embodiments, at least seventy percent of the rear reflective surface has a line of sight to the LEDs.

In some embodiments, the rear reflective surface includes an upper protruding reflective surface that extends inward generally toward the blocking reflective surface and is positioned upward from the blocking reflective surface.

Generally, in another aspect, an LED-based luminaire includes a lower reflective surface, a rear reflective surface extending upward from the lower reflective surface, and a blocking reflective surface having a lower end and an upper end. The lower end is more distal the rear reflective surface than the upper end is to the rear reflective surface and is more proximal the lower reflective surface than the upper end is to the lower reflective surface. A plurality of LEDs are also included interposed between the lower reflective surface and the blocking reflective surface. The LEDs primarily direct a light output toward the blocking reflective surface and include a first LED of a first color and a second LED of a second color distinct from the first color. A transmissive diffuser is also included extending over the blocking reflective surface and positioned between the rear reflective surface and the lower reflective surface. At least some of the light output from the LEDs is reflected by the blocking reflective surface, the lower reflective surface, then the rear reflective surface prior to passing through the transmissive diffuser. At least some of the light output is reflected by the rear reflective surface, without first reflecting off of the blocking reflective surface and the lower reflective surface, prior to passing through the transmissive diffuser.

In some embodiments, the transmissive diffuser is arcuate.

In some embodiments, the LED-based luminaire further includes a transmissive window interrupting the blocking reflective surface and positioned more proximal the lower end of the blocking reflective surface than the upper end of the blocking reflective surface.

In some embodiments, the blocking reflective surface is arcuate.

In some embodiments, the LED-based luminaire further includes an end cap at each end of the transmissive diffuser. In some versions of those embodiments, at least one of the end caps is transmissive.

In some embodiments, the blocking reflective surface and the lower reflective surface are at a fifteen to forty degree angle relative to one another.

In some embodiments, the transmissive diffuser extends behind the rear reflective surface such that the rear reflective surface is interposed between portions of the transmissive diffuser and the LEDs. The transmissive diffuser may extend entirely between the rear reflective surface and the lower reflective surface.

Generally, in another aspect, an LED-based luminaire includes a first and second lower reflective surface and first and second opposed rear surfaces extending upward from respective of the first and second lower reflective surface. The first and second opposed rear surfaces being substantially perpendicular to respective of the first and second lower reflective surfaces. A first blocking reflective surface is also included having a first lower end and a first upper end. The first lower end is more distal the first rear reflective surface than the first upper end is to the first rear reflective surface and more proximal the first lower reflective surface than the first upper end is to the first lower reflective surface. A second blocking reflective surface is also included having a second lower end and a second upper end. The second lower end is more distal the second rear reflective surface than the second upper end is to the second rear reflective surface and more proximal the second lower reflective surface than the second upper end is to the second lower reflective surface. A plurality of multi-channel first chamber LEDs are also included interposed between the first lower reflective surface and the first blocking reflective surface. The first chamber LEDs primarily direct a first chamber light output toward the first blocking reflective surface. A plurality of multi-channel second chamber LEDs are also included interposed between the second lower reflective surface and the second blocking reflective surface. The second chamber LEDs primarily direct a second chamber light output toward the second blocking reflective surface. A transmissive diffuser extends over the first blocking reflective surface and the second blocking reflective surface. A majority of the first light output and the second light output are each reflected at least once prior to passing through the transmissive diffuser.

In some embodiments, the transmissive diffuser includes a first diffuser and a second diffuser arranged end to end.

In some embodiments, the first rear reflective surface and the second rear reflective surface are on opposite sides of a common structure.

As used herein for purposes of the present disclosure, the term "LED" should be understood to include any electroluminescent diode or other type of carrier injection/junction-based system that is capable of generating radiation in response to an electric signal. Thus, the term LED includes, but is not limited to, various semiconductor-based structures that emit light in response to current, light emitting polymers, organic light emitting diodes (OLEDs), electroluminescent strips, and the like. In particular, the term LED refers to light emitting diodes of all types (including semi-conductor and organic light emitting diodes) that may be configured to generate radiation in one or more of the infrared spectrum, ultraviolet spectrum, and various portions of the visible spectrum (generally including radiation wavelengths from approximately 400 nanometers to approximately 700 nanometers). Some examples of LEDs include, but are not limited to, various types of infrared LEDs, ultraviolet LEDs, red LEDs, blue LEDs, green LEDs, yellow LEDs, amber LEDs, orange LEDs, and white LEDs (discussed further below). It also should be appreciated that LEDs may be configured and/or controlled to generate radiation having various bandwidths (e.g., full widths at half maximum, or FWHM) for a given spectrum (e.g., narrow bandwidth, broad bandwidth), and a variety of dominant wavelengths within a given general color categorization.

For example, one implementation of an LED configured to generate essentially white light (e.g., a white LED) may include a number of dies which respectively emit different spectra of electroluminescence that, in combination, mix to form essentially white light. In another implementation, a white light LED may be associated with a phosphor material that converts electroluminescence having a first spectrum to a different second spectrum. In one example of this implementation, electroluminescence having a relatively short wavelength and narrow bandwidth spectrum "pumps" the phosphor material, which in turn radiates longer wavelength radiation having a somewhat broader spectrum.

It should also be understood that the term LED does not limit the physical and/or electrical package type of an LED. For example, as discussed above, an LED may refer to a single light emitting device having multiple dies that are configured to respectively emit different spectra of radiation (e.g., that may or may not be individually controllable). Also, an LED may be associated with a phosphor that is considered as an integral part of the LED (e.g., some types of white LEDs). In general, the term LED may refer to packaged LEDs, non-packaged LEDs, surface mount LEDs, chip-on-board LEDs, T-package mount LEDs, radial package LEDs, power package LEDs, LEDs including some type of encasement and/or optical element (e.g., a diffusing lens), etc.

The term "light source" should be understood to refer to any one or more of a variety of radiation sources, including, but not limited to, LED-based sources (including one or more LEDs as defined above), incandescent sources (e.g., filament lamps, halogen lamps), fluorescent sources, phosphorescent sources, high-intensity discharge sources (e.g., sodium vapor, mercury vapor, and metal halide lamps), lasers, other types of electroluminescent sources, pyro-luminescent sources (e.g., flames), candle-luminescent sources (e.g., gas mantles, carbon arc radiation sources), photo-luminescent sources (e.g., gaseous discharge sources), cathode luminescent sources using electronic satiation, galvano-luminescent sources, crystallo-luminescent sources, kine-luminescent sources, thermo-luminescent sources, triboluminescent sources, sonoluminescent sources, radioluminescent sources, and luminescent polymers.

A given light source may be configured to generate electromagnetic radiation within the visible spectrum, outside the visible spectrum, or a combination of both. Hence, the terms "light" and "radiation" are used interchangeably herein. Additionally, a light source may include as an integral component one or more filters (e.g., color filters), lenses, or other optical components. Also, it should be understood that light sources may be configured for a variety of applications, including, but not limited to, indication, display, and/or illumination. An "illumination source" is a light source that is particularly configured to generate radiation having a sufficient flux to effectively illuminate an interior or exterior space. In this context, "sufficient flux" refers to sufficient radiant power in the visible spectrum generated in the space or environment to provide ambient illumination (i.e., light that may be perceived indirectly and that may be, for example, reflected off of one or more of a variety of intervening surfaces before being perceived in whole or in part). Sufficient flux may also refer to radiation measured in lumens.

The term "spectrum" should be understood to refer to any one or more frequencies (or wavelengths) of radiation produced by one or more light sources. Accordingly, the term "spectrum" refers to frequencies (or wavelengths) not only in the visible range, but also frequencies (or wavelengths) in the infrared, ultraviolet, and other areas of the overall electromagnetic spectrum. Also, a given spectrum may have a relatively narrow bandwidth (e.g., a FWHM having essentially few frequency or wavelength components) or a relatively wide bandwidth (several frequency or wavelength components having various relative strengths). It should also be appreciated that a given spectrum may be the result of a mixing of two or more other spectra (e.g., mixing radiation respectively emitted from multiple light sources, each having a unique spectrum).

For purposes of this disclosure, the term "color" is used interchangeably with the term "spectrum." However, the term "color" generally is used to refer primarily to a property of radiation that is perceivable by an observer (although this usage is not intended to limit the scope of this term). Accordingly, the terms "different colors" implicitly refer to multiple spectra having different wavelength components and/or bandwidths. It also should be appreciated that the term "color" may be used in connection with both white and non-white light.

The term "color temperature" generally is used herein in connection with white light, although this usage is not intended to limit the scope of this term. Color temperature essentially refers to a particular color content or shade (e.g., reddish, bluish) of white light. The color temperature of a given radiation sample conventionally is characterized according to the temperature in Kelvin (K) of a blackbody radiator that radiates essentially the same spectrum as the radiation sample in question. Blackbody radiator color temperatures generally fall within a range of approximately 700 K to over 10,000 K; white light generally is perceived at color temperatures above 1500-2000 K.

Lower color temperatures generally indicate white light having a more significant red component or a "warmer feel," while higher color temperatures generally indicate white light having a more significant blue component or a "cooler feel." By way of example, fire has a color temperature of approximately 1,800 K, a conventional incandescent bulb has a color temperature of approximately 2848 K, early morning daylight has a color temperature of approximately 3,000 K, and overcast midday skies have a color temperature of approximately 10,000 K. A color image viewed under white light having a color temperature of approximately 3,000 K has a relatively reddish tone, whereas the same color image viewed under white light having a color temperature of approximately 10,000 K has a relatively bluish tone.

The term "lighting unit" is used herein to refer to an apparatus including one or more light sources of same or different types. A given lighting unit may have any one of a variety of mounting arrangements for the light source(s), enclosure/housing arrangements and shapes, and/or electrical and mechanical connection configurations. Additionally, a given lighting unit optionally may be associated with (e.g., include, be coupled to and/or packaged together with) various other components (e.g., control circuitry) relating to the operation of the light source(s). An "LED-based lighting unit" refers to a lighting unit that includes one or more LED-based light sources as discussed above, alone or in combination with other non LED-based light sources. A "multi-channel" lighting unit refers to an LED-based or non LED-based lighting unit that includes at least two light sources configured to respectively generate different spectrums of radiation, wherein each different source spectrum may be referred to as a "channel" of the multi-channel lighting unit.

The terms "lighting fixture" and "luminaire" are used interchangeably herein to refer to an implementation or arrangement of one or more lighting units in a particular form factor, assembly, or package. In some implementations the LED-based luminaire described herein may be utilized in a directly viewable (or "direct view") product. For example, in some embodiments one or more LED-based luminaires may be implemented such that a user may directly view light emitting portions of the exterior of the LED-based luminaire. In some versions of those embodiments the internal mixing of the LED-based luminaire may sufficiently mix multi-channel LEDs within the LED-based luminaire such that the LED-based luminaire appears to emit a uniform light when directly viewed.

The term "controller" is used herein generally to describe various apparatus relating to the operation of one or more light sources. A controller can be implemented in numerous ways (e.g., such as with dedicated hardware) to perform various functions discussed herein. A "processor" is one example of a controller which employs one or more microprocessors that may be programmed using software (e.g., microcode) to perform various functions discussed herein. A controller may be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, conventional microprocessors, application specific integrated circuits (ASICs), and field-programmable gate arrays (FPGAs).

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

Mixing solutions are implemented in many lighting fixtures that embody LEDs of different colors in order to provide mixing of the colors and improved light output characteristics. In implementing mixing solutions, many lighting fixtures employ multiple large mixing chambers and/or only provide illumination from a single planar light exit opening. Such configurations may result in an undesirably large mixing solution and/or a mixing solution of limited utility. Thus, Applicants have recognized a need for an LED-based luminaire that may provide satisfactory mixing of light output from a plurality of LEDs thereof and that may optionally overcome one or more drawbacks with existing mixing solutions.

The LED-based luminaire may include a mixing optic surrounding a plurality of LEDs. The LEDs may optionally be of different colors. The mixing optic includes a plurality of interior reflective surfaces for mixing light output of the LEDS. The mixing optic also includes a transmissive diffuser through which interiorly reflected light output of the LEDs exits the LED-based luminaire. The configuration of the LED-based luminaire enables it to be compact and low profile in various embodiments, thereby enabling its utilization in space limited applications. In some implementations a plurality of the LED-based luminaires may be installed adjacent one another on one or more installation surfaces, with each LED-based luminaire forming a single pixel of a multi-pixel display.

More generally, Applicants have recognized and appreciated that it would be beneficial to provide an LED-based luminaire that may provide satisfactory mixing of light output from a plurality of LEDs thereof.

Figure 1:
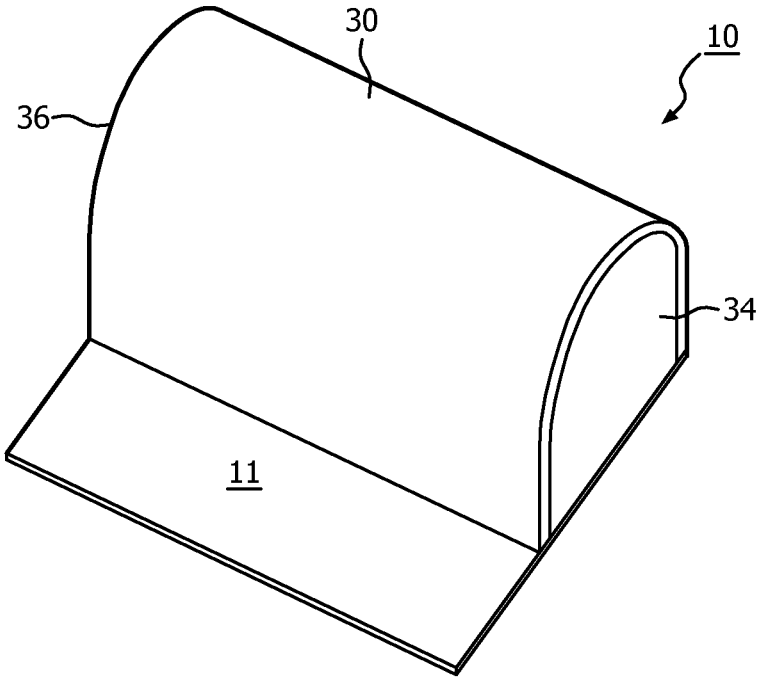
FIG. 1 illustrates a perspective view of a first embodiment of an LED-based luminaire.
Figure 2:
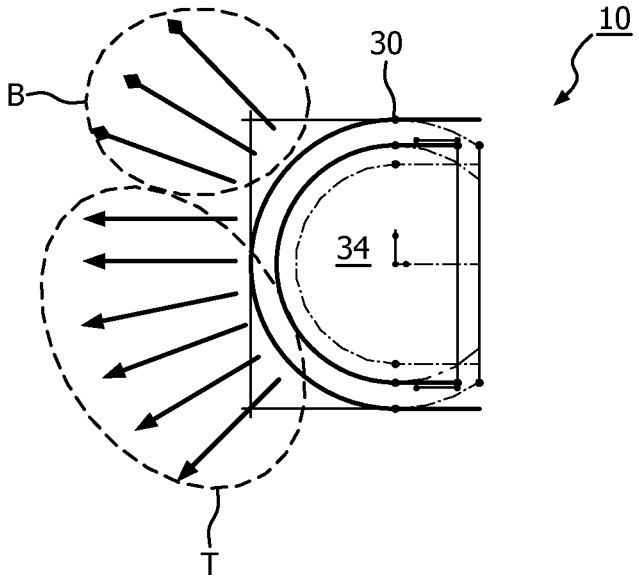
FIG. 2 illustrates a side view of the LED-based luminaire of FIG. 1; a light blocking area and a light transmission area are also illustrated.

In view of the foregoing, various embodiments and implementations of the present invention are directed to an LED-based luminaire. Referring to FIGS. 1 and 2, a first embodiment of an LED-based luminaire 10 is illustrated. FIG. 1 illustrates a perspective view of the LED-based luminaire 10 mounted atop surface 11. The LED-based luminaire 10 includes a semi-cylindrical outer transmissive diffuser 30 having opaque end caps 34, 36 over the ends thereof. In alternative embodiments one or both of the end caps 34, 36 may be transmissive and may optionally diffuse light transmitted therethrough.

A side view of the LED-based luminaire 10 is illustrated in FIG. 2. The side view also illustrates a light blocking area B generally indicated by a plurality of diamond headed arrows and a light transmission area T generally indicated by a plurality of arrows. The light blocking area B generally defines an area where light from LEDs interior of LED-based luminaire 10 will not be transmitted. The light may be blocked from area B via, for example, one or more interior reflective structures as described herein. The light transmission area T generally defines an area where light from LEDs interior of the LED-based luminaire 10 will be transmitted via one or more reflections off interior reflective structures as described herein. The configuration illustrated in FIG. 2 may be utilized, for example, when the LED-based luminaire 10 is attached vertically on a structure such as a window section in a building. In such an implementation light blocking area B will be toward the sky to prevent undesired light pollution and light transmission area T will be toward the desired illumination target. One of skill in the art, having had the benefit of the present disclosure, will recognize and appreciate that the placement and/or size of light blocking area B and/or light transmission area T may be adjusted as desired to achieve desired light output characteristics for a particular application. For example, in some applications multiple LED-based luminaires may share a surface and each may be configured with a unique light blocking and light transmitting area.

Figure 3A:
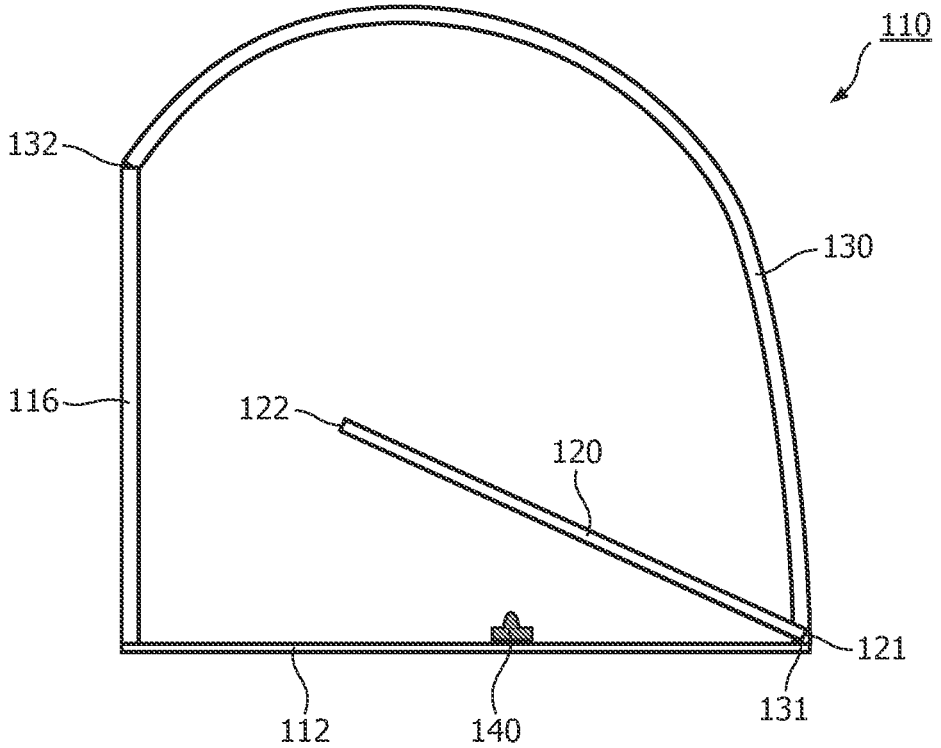
FIG. 3A illustrates a side schematic view of a second embodiment of an LED-based luminaire.

FIG. 3A illustrates a side schematic view of a second embodiment of an LED-based lighting unit 110. The lighting unit 110 includes a lower structure 112 and a rear structure 116. The rear structure 116 extends upward from the lower structure 112 and is perpendicular to the lower structure 112. Both the lower structure 112 and the rear structure 116 have interior surfaces that are reflective. In some embodiments one or more of the interior surfaces may be diffusely reflective. In some embodiments one or more of the interior surfaces may be specularly reflective. Although the lower structure 112 and rear structure 116 are illustrated as being two separate pieces that are immediately adjacent and perpendicular to one another, in alternative embodiments the lower structure 112 and rear structure 116 may have other configurations. For example, in some embodiments the lower structure 112 and rear structure 116 may be formed from a cohesive piece of material and/or may be at a non-perpendicular angle relative to one another. Also, for example, in some embodiments a non-reflective gap may optionally be present between lower structure 112 and rear structure 116.

A blocking reflective structure 120 is also provided and includes a lower end 121 and an upper end 122. The lower end 121 is adjacent an end of the lower structure 112 that is most distal the rear structure 116. The upper end 122 is farther from the lower structure 112 than the lower end 121 is, and is closer to the rear structure 116 than the lower end 121 is. At least the surface of the blocking structure 120 that faces the lower structure 112 is reflective. In some embodiments the surface may be diffusely reflective. In some embodiments the surfaces of the blocking structure 120 that face transmissive diffuser 130 may also be reflective. Although the blocking structure 120 is illustrated as being separate from and at a particular angle relative to lower structure 112, in alternative embodiments the blocking structure 120 and rear structure 116 may be formed from a cohesive piece of material and/or may be at another angle relative to one another.

A plurality of LEDs 140 are mounted atop the lower structure 112. Only one of the LEDs 140 is illustrated in FIG. 3A, since the other LEDs are arranged linearly behind that LED. In alternative embodiments the LEDs may be arranged in a non-linear array. The LEDs 140 are arranged such that the light output thereof is primarily directed in a direction away from the lower structure 112 and toward the blocking reflective structure 120. As illustrated in FIG. 3D, the LEDs 140 include LEDs 140Y, 140G, 140B, 140R, and 140W, that emit respective of yellow, green, blue, red, and white colors. In alternative embodiments more or fewer LEDs may be provided and/or they may optionally emit alternative colors. In some embodiments one or more of the LEDs may be mounted on an alternative structure such as, for example, a thermal interface pad atop the lower structure 112, a heatsink above the lower structure 112, and/or other mounting structure. In some embodiments one or more of the LEDs 140 may be mounted at an alternative angle than depicted in the Figures. For example, in some embodiments the main output axis of one or more of the LEDs 140 may be shifted toward the rear surface 116.

A transmissive diffuser 130 has a first end 131 adjacent an end of the lower structure 112 and a second end adjacent an upper end of the rear structure 116. The transmissive diffuser 130 is arcuate and extends over the blocking structure 120. In alternative embodiments the transmissive diffuser 130 may extend across less or more distance than depicted. For example, in some embodiments the second end 132 may extend behind the rear structure 116 such as shown with transmissive diffuser 30 in FIG. 1. Also, for example, in some embodiments the transmissive diffuser 130 may not extend all the way to the lower end 121 of blocking structure 120 and/or may not extend all the way to rear structure 116. The transmissive diffuser 130 transmits light therethrough and also diffuses the light as it is transmitted therethrough.

Figure 3B:
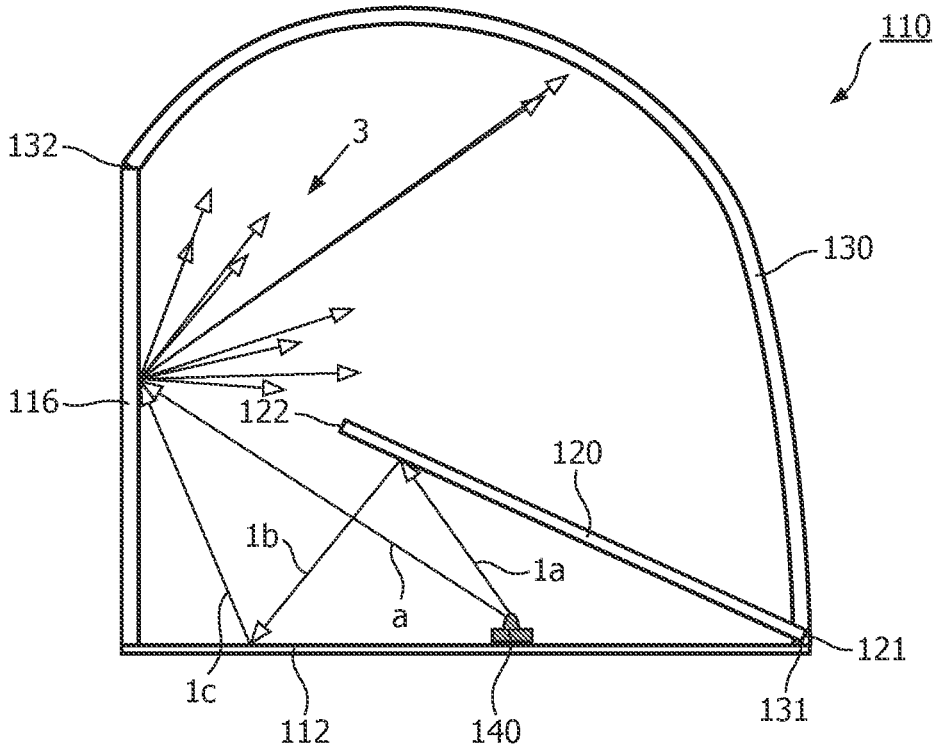
FIG. 3B illustrates the side schematic view of the second embodiment of an LED-based luminaire of FIG. 3A and also illustrates exemplary light rays that have emanated from one of the LEDs of the LED-based luminaire.

FIG. 3B illustrates the side schematic view of the LED-based luminaire 110 and also illustrates exemplary light rays 1*a* and 2 that have emanated from one of the LEDs 140. It is understood that additional light rays will be emitted and that light rays 1*a* and 2 are discussed and illustrated for descriptive purposes. Light rays 1*a* are directed toward the reflective surface of blocking structure 120, reflected as light rays 1*b* toward the reflective surface of lower structure 112, then reflected as light rays 1*c* toward the reflective surface of rear structure 116. Light rays 2 are emitted from LED 140 directly toward the reflective surface of rear structure 116. The light rays 2 and reflected light rays 1*c* are diffusely reflected at the reflective surface of rear structure 116 and directed toward the transmissive diffuser 130 as light rays 3.

Figure 3C:
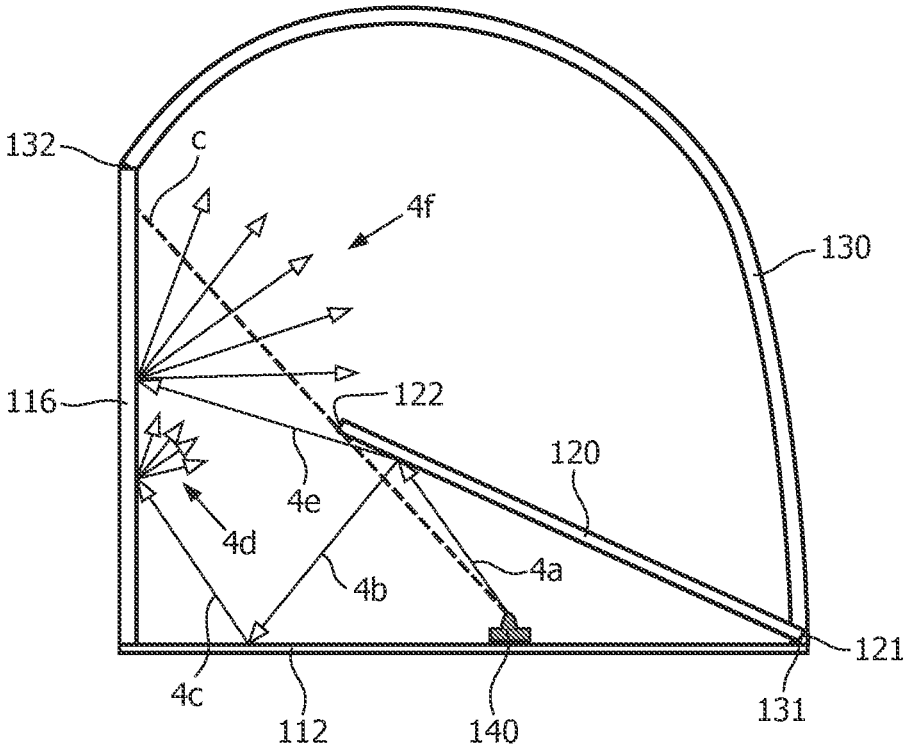
FIG. 3C illustrates the side schematic view of the second embodiment of an LED-based luminaire of FIG. 3A and also illustrates a line of sight cut-off line of the LEDs of the LED-based luminaire and exemplary light rays that have emanated from one of the LEDs.
Figure 3D:
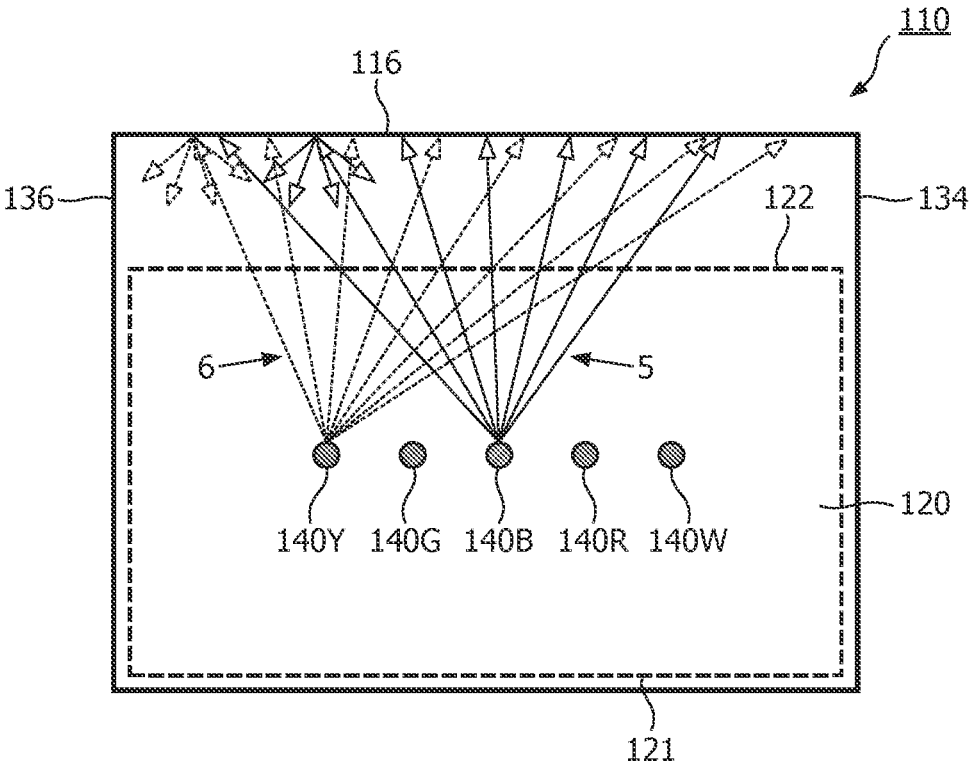
FIG. 3D illustrates a top schematic view of the second embodiment of an LED-based luminaire of FIG. 3A, with a transmissive diffuser of the LED-based luminaire being removed and with a blocking reflector of the LED-based luminaire being illustrated in phantom; exemplary light rays are illustrated that have emanated from two of the LEDs of the LED-based luminaire.

FIG. 3C illustrates the side schematic view of the LED-based luminaire 110 and also illustrates a line of sight cut-off line C of the LEDs 140 and exemplary light rays 4*a* that have emanated from one of the LEDs. The light rays 4*a* are directed toward the reflective surface of blocking structure 120, reflected as light rays 4*b* toward the reflective surface of lower structure 112, and reflected as light rays 4*e* toward the reflective surface of rear structure 116. The light rays 4*b* are reflected as light rays 4*c* toward the reflective surface of rear structure 116, where they are diffusely reflected as light rays 4*d* toward the transmissive diffuser 130 and toward the reflective surface of the blocking structure 120 for additional reflection. The light rays 4*e* are diffusely reflected as light rays 4*f* toward the transmissive diffuser 130.

The cut-off line C of the LEDs 140 illustrates a cut-off line of line of sight to the LEDs 140. As illustrated, the LEDs 140 do not have a straight line of sight to the transmissive diffuser 130. Accordingly, light rays emitted from the LEDs 140 do not directly contact the transmissive diffuser 130 in the illustrated embodiment. Rather, light rays emitted from the LEDs 140 are reflected off one or more reflective surfaces prior to passing through the transmissive diffuser 130. The cut-off line C extends approximately 90% of the way up the rear structure 116. In alternative embodiments the cut-off line C may extend farther up or not as far up the rear structure 116 (e.g., via the manipulation of the length of blocking structure 120 and/or rear structure 116). Also, in some embodiments the cut-off line C may extend onto the transmissive diffuser 130 (e.g., via the manipulation of the length of blocking structure 120). For example, in some embodiments the cut-off line C may extend a few millimeters onto the transmissive diffuser 130.

FIG. 3D illustrates a top schematic view of the LED-based luminaire 110. The transmissive diffuser 130 is removed in FIG. 3D. The blocking reflector 120 is illustrated with broken lines along the periphery and as being semi-transparent so as to enable viewing of the LEDs 140 underneath the blocking reflector 120. Exemplary light rays 5 are illustrated that have emanated from blue LED 140B and exemplary light rays 6 are illustrated that have emanated from yellow LED 140Y. The other LEDs 140G, 140R, and 140W are not activated in FIG. 3D. The LEDs 140 may be coupled to a controller for selectively activating one or more of the LEDs 140 to achieve a desired color output as described herein. Light rays 6 are directed toward the reflective surface of rear structure 116 where they are diffusely reflected horizontally. Similarly, light rays 5 are directed toward the reflective surface of rear structure 116 where they are diffusely reflected horizontally. End caps 134 and/or 136 may have reflective interior surfaces in some embodiments. In some embodiments end caps 134 and/or 136 may be transmissive.

In some embodiments, the LED-based luminaire 110 and other LED-based luminaires described herein may be compact and low profile, thereby enabling their utilization in space limited applications. For example, various configurations described herein may enable the LED-based luminaire 110 to be approximately 30 mm tall (from bottom of lower structure 112 to top of transmissive diffuser 130).

Figure 4:
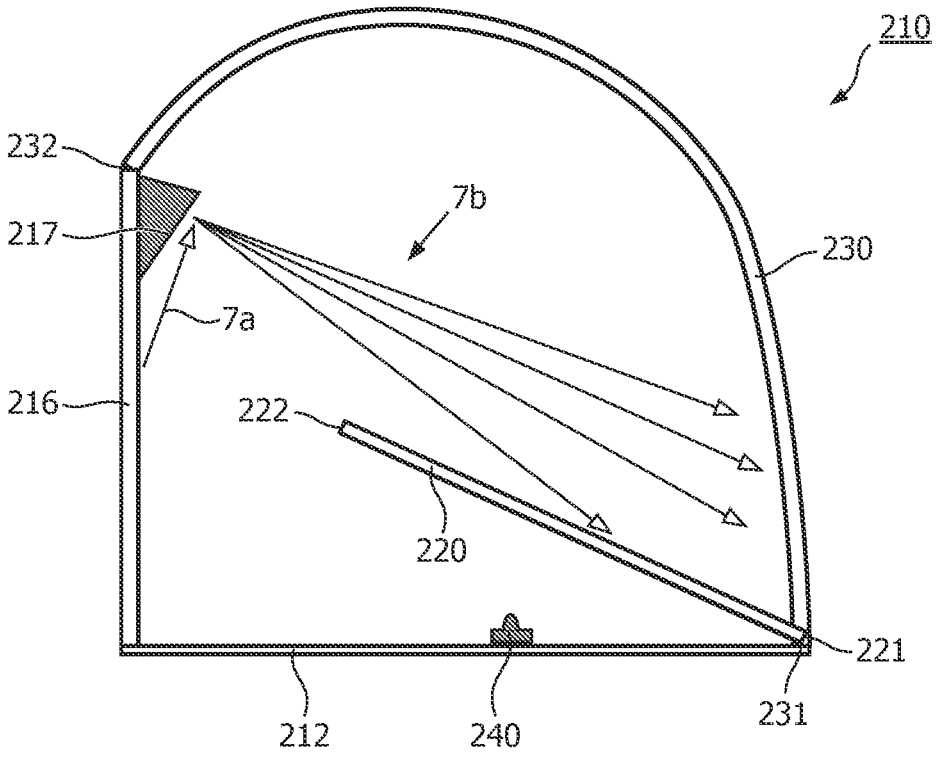
FIG. 4 illustrates a side schematic view of a third embodiment of an LED-based luminaire and also illustrates exemplary light rays that have emanated from one of the LEDs of the LED-based luminaire.

FIG. 4 illustrates a side schematic view of a third embodiment of an LED-based luminaire 210. FIG. 4 also illustrates exemplary light rays 7*a* that have emanated from one of the LEDs 240 of the LED-based luminaire 210. In the embodiments of FIGS. 4-9, several elements of the LED-based luminaires thereof share a similar configuration with certain elements of LED-based luminaire 110. Accordingly, description concerning many aspects of the LED-based lighting of FIGS. 4-9 is omitted herein for purpose of conciseness. However, it is understood that certain aspects of LED-based luminaires having numbering of _XX share a common configuration with those aspects of LED-based lighting 110 having numbering of 1XX, except as discussed and/or illustrated herein to the contrary. For example, lower structure 212 has a similar configuration as lower structure 112.

In FIG. 4, a reflective diffuser 217 protrudes from an upper portion of the rear structure 216. The reflective diffuser 217 has a diffusely reflective surface that directs more light toward the first end 231 of the transmissive diffuser 230. For example, light rays 7*a* incident thereon are diffusely reflected as light rays 7*b*. In alternative embodiments the reflective diffuser 217 may be specularly reflective and/or may be cohesively formed with rear structure 216. Also, one of skill in the art having had the benefit of the present disclosure will recognize and appreciate that reflective diffuser 217 may be alternatively configured and/or angled to direct light rays incident thereon toward different portions of transmissive diffuser 230.

Figure 5:
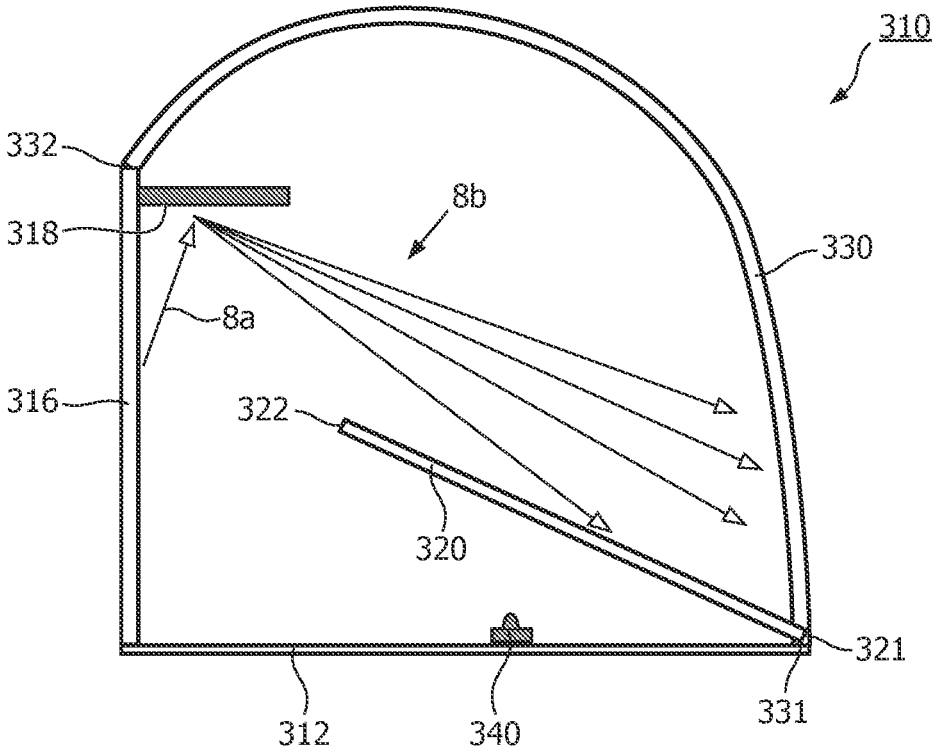
FIG. 5 illustrates a side schematic view of a fourth embodiment of an LED-based luminaire and also illustrates exemplary light rays that have emanated from one of the LEDs of the LED-based luminaire.

FIG. 5 illustrates a side schematic view of a fourth embodiment of an LED-based luminaire 310. A reflective diffuser 318 protrudes from an upper portion of the rear structure 316 and is substantially perpendicular to the rear structure 316. The reflective diffuser 318 has a diffusely reflective surface that directs more light toward the first end 331 of the transmissive diffuser 330. For example, light rays 8*a* incident thereon are diffusely reflected as light rays 8*b*. In alternative embodiments the reflective diffuser 318 may be specularly reflective and/or may be cohesively formed with rear structure 316. Also, one of skill in the art having had the benefit of the present disclosure will recognize and appreciate that reflective diffuser 318 may be alternatively configured and/or angled to direct light rays incident thereon toward different portions of transmissive diffuser 330.

Figure 6:
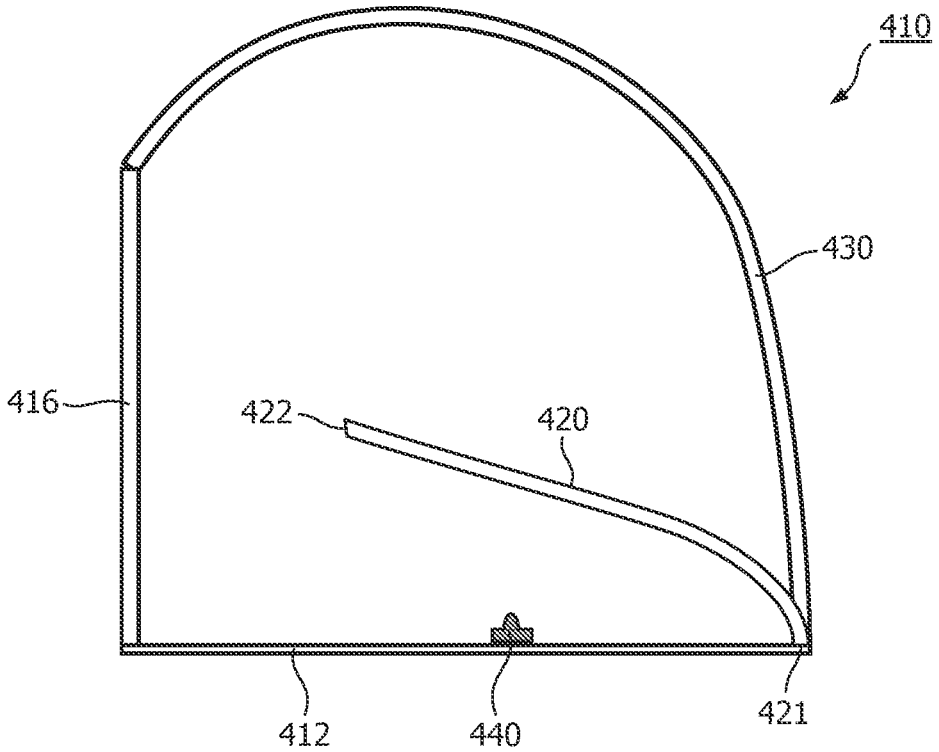
FIG. 6 illustrates a side schematic view of a fifth embodiment of an LED-based luminaire.

FIG. 6 illustrates a side schematic view of a fifth embodiment of an LED-based luminaire 410. A blocking structure 420 is provided that has an arcuate shape. The shape of the blocking structure 420 is arcuate to change the mixing performance of the LED-based luminaire. One of skill in the art, having had the benefit of the present disclosure, will recognize and appreciate that other shapes of blocking structure 420 may be utilized to achieve other desired mixing performance characteristics.

Figure 7:
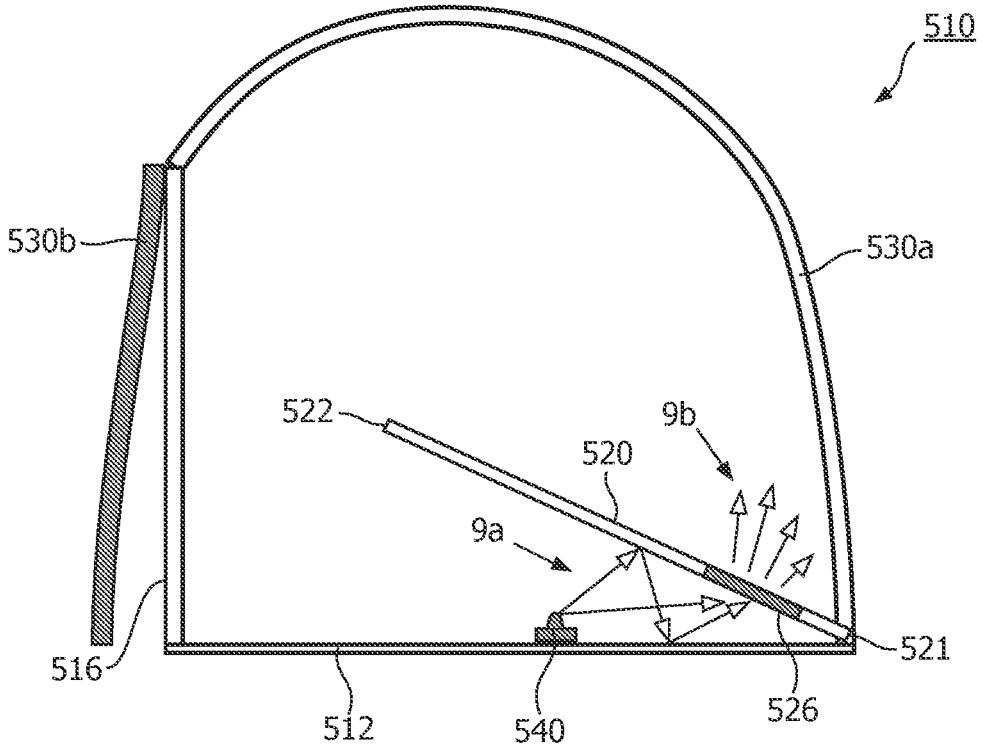
FIG. 7 illustrates a side schematic view of a sixth embodiment of an LED-based luminaire and also illustrates exemplary light rays that have emanated from one of the LEDs of the LED-based luminaire.

FIG. 7 illustrates a side schematic view of a sixth embodiment of an LED-based luminaire 510 and also illustrates exemplary light rays 9*a* that have emanated from one of the LEDs 540 of the LED-based luminaire 510. The LED-based luminaire 510 includes a transmissive diffuser having a first transmissive diffuser section 530*a* and a second transmissive diffuser section 530*b*. In alternative embodiments the transmissive diffuser sections 530*a* and 530*b* may be cohesively formed. The second transmissive diffuser section 530*b* may be provided for aesthetic purposes.

The blocking structure 520 includes a transmissive window 526 therein toward the first end 521. The transmissive window 526 is a diffusing window and will increase the brightness of the light exiting the transmissive diffuser 530 adjacent the transmissive window 526. Light rays 9*a* are directed toward the transmissive window 526 and are diffused as they pass through the transmissive window 526 as light rays 9*b*. As illustrated, some of the light rays may only be refracted through transmissive window 526 and transmissive diffuser 530 prior to exiting the LED-based luminaire 510. However, the majority of the light output of the LEDs 540 is reflected by structures 520, 512, and/or 516 prior to exiting the LED-based luminaire 510.

Figure 8:
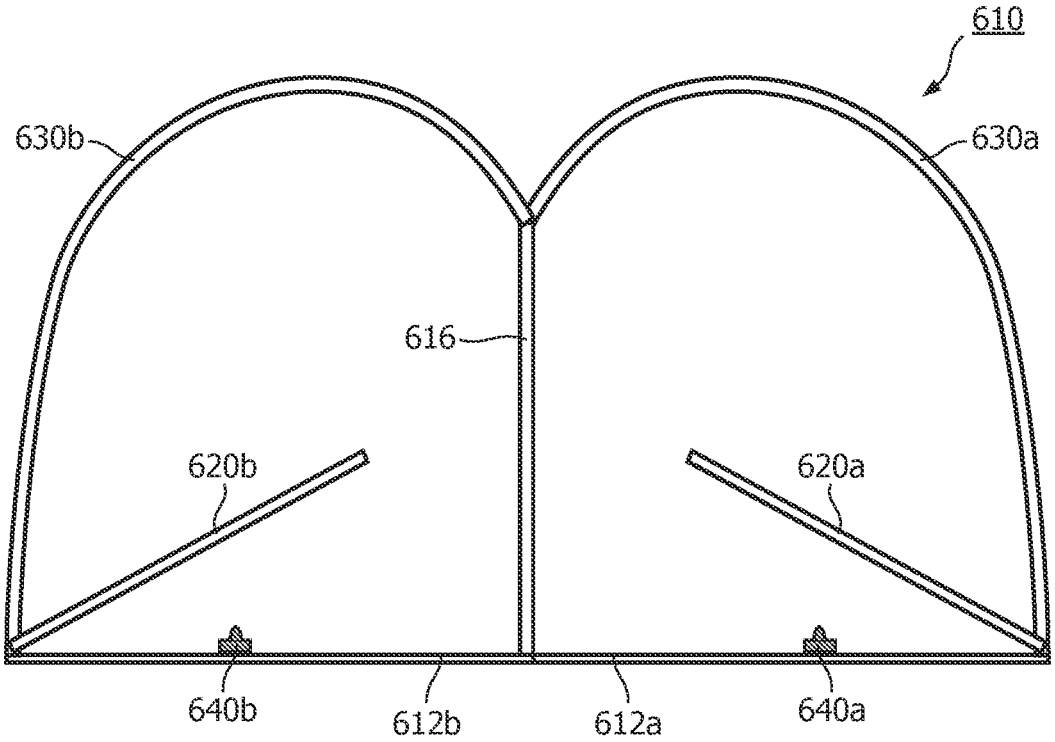
FIG. 8 illustrates a side schematic view of a seventh embodiment of an LED-based luminaire.

FIG. 8 illustrates a side schematic view of a seventh embodiment of an LED-based luminaire 610. The LED-based luminaire 610 includes two separate chambers divided by rear structure 616. The rear structure 616 is diffusely reflective on each side thereof. Light output from LEDs 640*a* is emitted through transmissive diffuser 630*a* after one or more reflections off structures 620*a*, 612*a*, and/or 616. Light output from LEDs 640*b* is emitted through transmissive diffuser 630*b* after one or more reflections off structures 620*b*, 612*b*, and/or 616. In other embodiments the transmissive diffusers 630*a*, 630*b* may be cohesively formed. In some embodiments the rear structure 616 may include at least a first structure and a second structure.

Figure 9:
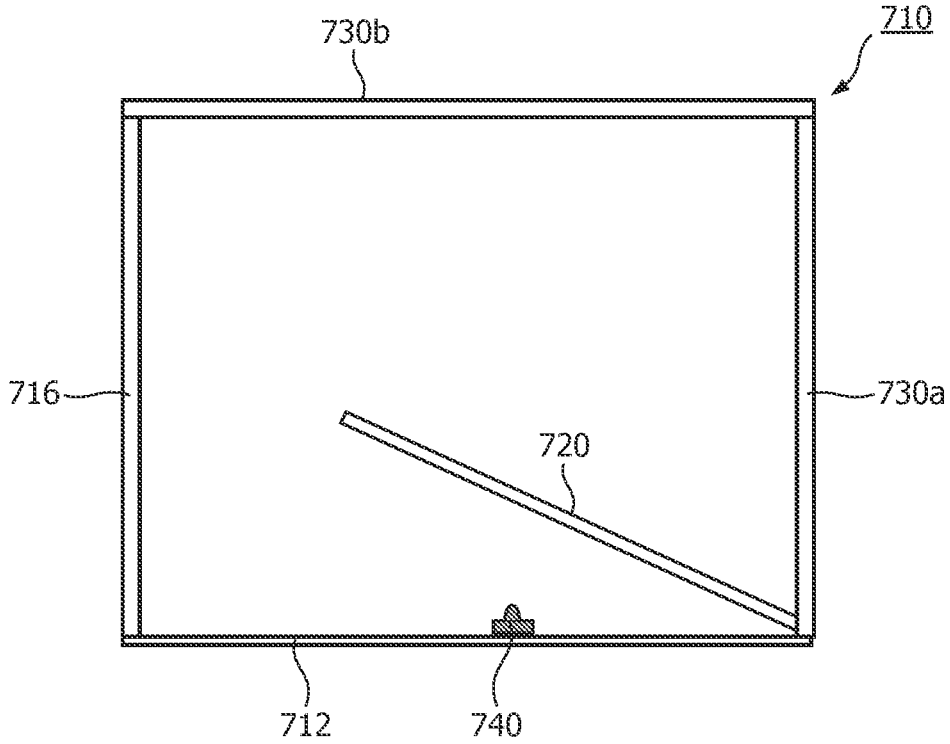
FIG. 9 illustrates a side schematic view of an eighth embodiment of an LED-based luminaire.

FIG. 9 illustrates a side schematic view of an eighth embodiment of an LED-based luminaire 710. The LED-based luminaire 710 includes a transmissive diffuser having a first planar transmissive diffuser section 730*a* and a second planar transmissive diffuser section 730*b*. The planar transmissive diffuser section 730*a*, 730*b* may optionally be cohesively formed.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified.

It should also be understood that, unless clearly indicated to the contrary, in any methods claimed herein that include more than one step or act, the order of the steps or acts of the method is not necessarily limited to the order in which the steps or acts of the method are recited.

Also, reference numerals appearing in parentheses in the claims are provided merely for convenience and should not be construed as limiting the claims in any way.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

What is claimed is:

1. An LED-based luminaire, comprising:

a lower reflective surface;

a plurality of LEDs atop said lower reflective surface;

a blocking reflective surface provided over said LEDs past a zenith of said LEDs and extending toward a rear reflective surface, said blocking reflective surface having a lower end and an upper end, said lower end being more distal said rear reflective surface than said upper end is to said reflective surface and said lower end being more proximal said lower reflective surface than said upper end is to lower reflective surface;

a transmissive diffuser extending over said blocking reflective surface;

wherein said blocking reflective surface is interposed between said lower reflective surface and said transmissive diffuser; and wherein at least some of a light output from said LEDs is reflected by said blocking reflective surface, said lower reflective surface, then said rear reflective surface prior to passing through said transmissive diffuser.

2. The LED-based luminaire of claim 1, wherein said transmissive diffuser is arcuate.

3. The LED-based luminaire of claim 1, wherein said transmissive diffuser is out of a line of sight to said LEDs.

4. The LED-based luminaire of claim 3, wherein said blocking reflective surface is linear.

5. The LED-based luminaire of claim 1, wherein said rear reflective surface and said lower reflective surface are substantially perpendicular to one another.

6. The LED-based luminaire of claim 1, wherein said transmissive diffuser extends toward said lower reflective surface to a first location that is more proximal to said lower reflective surface than said upper end of said blocking reflective surface is to said lower reflective surface.

7. The LED-based luminaire of claim 1, wherein said rear reflective surface extends to a rear reflective surface upper extent, and wherein said transmissive diffuser extends toward said lower reflective surface to a first location that is more proximal to said lower reflective surface than said rear reflective surface upper extent is to said lower reflective surface.

8. The LED-based luminaire of claim 1, wherein said transmissive diffuser substantially extends to said lower reflective surface.

9. The LED-based luminaire of claim 8, wherein said transmissive diffuser substantially extends to said rear reflective surface.

10. The LED-based luminaire of claim 1, wherein said blocking reflective surface bifurcates a majority of said lower reflective surface from said transmissive diffuser.

11. The LED-based lumnaire of claim 1, wherein said blocking reflective surface intersects a majority of said light output from said LEDs.

12. The LED-based luminaire of claim 1, wherein said rear reflective surface includes an upper protruding reflective surface, said upper protruding reflective surface extending inward generally toward said blocking reflective surface and positioned upward from said blocking reflective surface.

13. The LED-based luminaire of claim 1, wherein at least some of said light output from said LEDs is reflected by said blocking reflective surface, said lower reflective surface, then said rear reflective surface prior to passing through said transmissive diffuser.

14. The LED-based luminaire of claim 1, further comprising a transmissive window interrupting said blocking reflective surface and positioned more proximal said lower end of said blocking reflective surface than said upper end of said blocking reflective surface.

15. The LED-based luminaire of claim 1 wherein said transmissive diffuser extends entirely between said rear reflective surface and said lower reflective surface.

16. An LED-based luminaire, comprising:

a lower reflective surface;

a rear reflective surface extending upward from said lower reflective surface;

a blocking reflective surface having a lower end and an upper end, said lower end more distal said rear reflective surface than said upper end is to said rear reflective surface and more proximal said lower reflective surface than said upper end is to said lower reflective surface;

a plurality of LEDs interposed between said lower reflective surface and said blocking reflective surface, said LEDs primarily directing a light output toward said blocking reflective surface and including a first LED of a first color and a second LED of a second color distinct from said first color;

a transmissive diffuser extending over said blocking reflective surface and positioned between said rear reflective surface and said lower reflective surface;

wherein at least some of said light output from said LEDs is reflected by said blocking reflective surface, said lower reflective surface, then said rear reflective surface prior to passing through said transmissive diffuser; and wherein at least some of said light output is reflected by said rear reflective surface, without first reflecting off of said blocking reflective surface and said lower reflective surface, prior to passing through said transmissive diffuser.

17. The LED-based luminaire of claim 16, wherein said transmissive diffuser and/or said blocking reflective surface is arcuate.

18. The LED-based luminaire of claim 16, further comprising a transmissive window interrupting said blocking reflective surface and positioned more proximal said lower end of said blocking reflective surface than said upper end of said blocking reflective surface.

19. The LED-based luminaire of claim 16, further comprising a transmissive end cap at each end of said transmissive diffuser.

20. The LED-based luminaire of claim 16, wherein said blocking reflective surface and said lower reflective surface are at a fifteen to forty degree angle relative to one another.

21. The LED-based luminaire of claim 16 wherein said transmissive diffuser extends behind said rear reflective surface such that said rear reflective surface is interposed between portions of said transmissive diffuser and said LEDs.

22. The LED-based luminaire of claim 16 wherein said transmissive diffuser extends entirely between said rear reflective surface and said lower reflective surface.

* * * * *